US007628640B2

(12) United States Patent
Radle

(10) Patent No.: US 7,628,640 B2
(45) Date of Patent: Dec. 8, 2009

(54) ELECTRICAL CONNECTOR FOR CONNECTION TO MULTIPLE CONDUCTORS

(75) Inventor: Patrick J. Radle, Mequon, WI (US)

(73) Assignee: Actuant Corporation, Butler, WI (US)

( * ) Notice: Subject to any disclaimer, the term of this patent is extended or adjusted under 35 U.S.C. 154(b) by 0 days.

(21) Appl. No.: 12/334,591

(22) Filed: Dec. 15, 2008

(65) Prior Publication Data

US 2009/0156041 A1 Jun. 18, 2009

Related U.S. Application Data

(60) Provisional application No. 61/013,912, filed on Dec. 14, 2007.

(51) Int. Cl.
*H01R 11/20* (2006.01)

(52) U.S. Cl. ..... 439/441; 439/835

(58) Field of Classification Search ..... 439/441, 439/786, 787, 834, 835

See application file for complete search history.

(56) References Cited

U.S. PATENT DOCUMENTS 6,146,187 A * 11/2000 Pallai ..... 439/441
6,712,649 B2 * 3/2004 Mano et al. ..... 439/835

* cited by examiner

*Primary Examiner*—Tho D Ta
(74) *Attorney, Agent, or Firm*—Quarles & Brady LLP

(57) ABSTRACT

The present invention provides an electrical connector for connection to multiple conductors. The connector comprises a connector housing and at least two spring clamps in the housing. Each spring clamp has an open position to permit insertion of a conductor and a closed position in which the spring clamp engages the conductor to establish an electrical connection therewith. The connector further comprises a cam shaft having at least two axially spaced cam positions thereon. One of the cam positions is aligned with each spring clamp to open the spring clamps when the cam shaft is turned to an open position and to allow the spring clamps to close when the cam shaft is turned to a closed position. The connector further comprises a lever on said cam shaft for turning the cam shaft between the open and closed positions. The connector further comprises passageways in the connector housing, one for each spring clamp, leading a conductor inserted into the passageway into the corresponding spring clamp when the spring clamp is in the open position.

20 Claims, 10 Drawing Sheets

FIG. 12
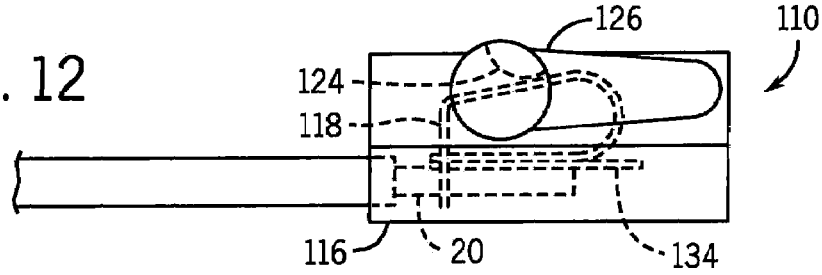
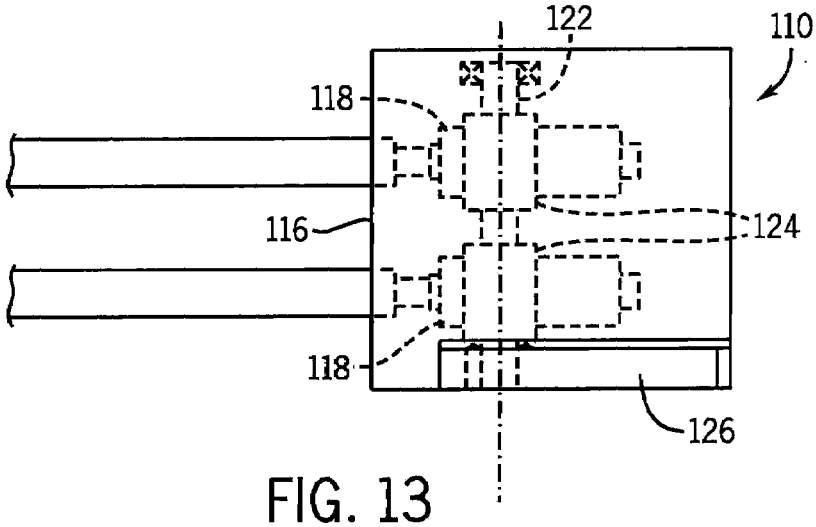
FIG. 13
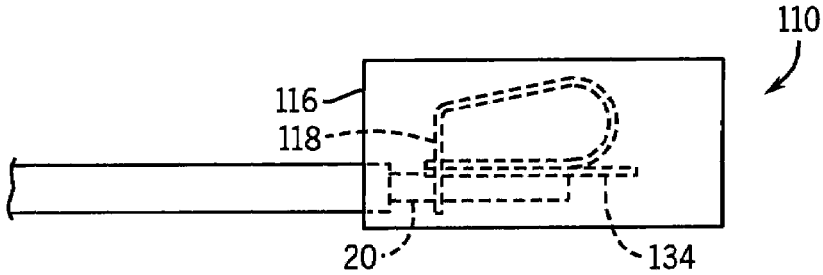
FIG. 14
FIG. 15
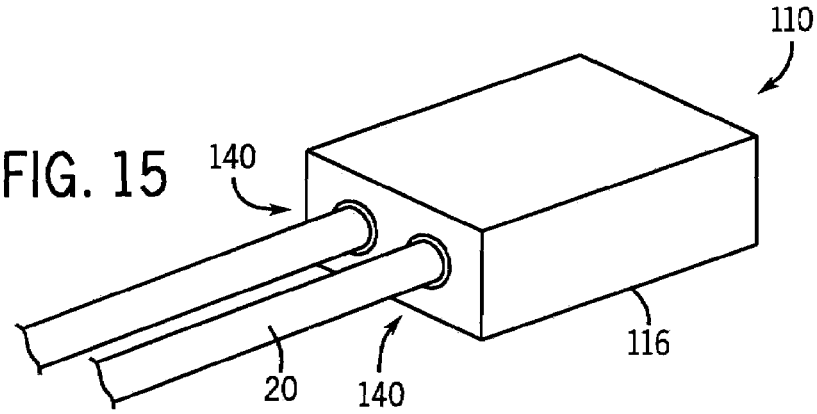

FIG. 16
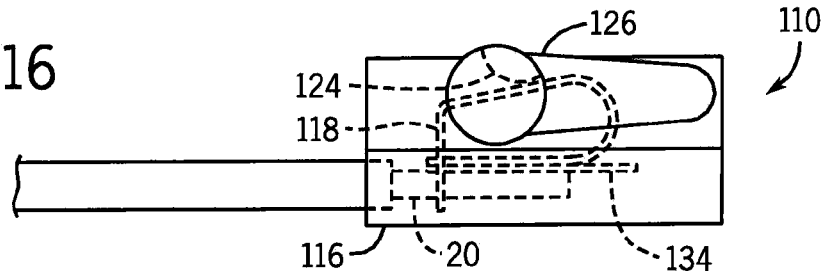
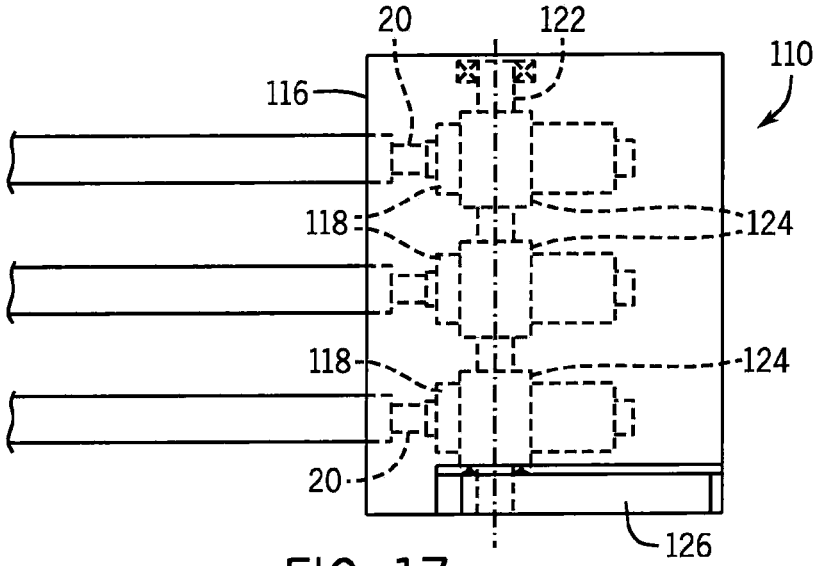
FIG. 17
FIG. 18
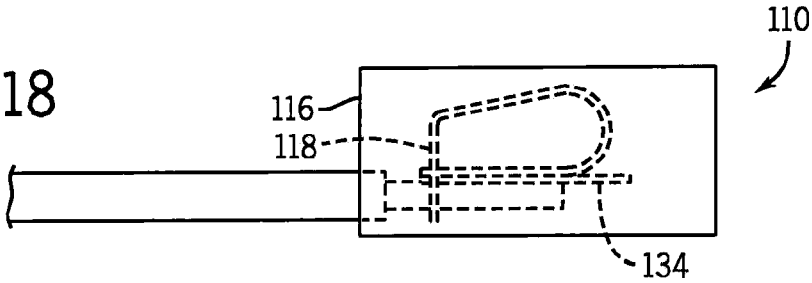
FIG. 19
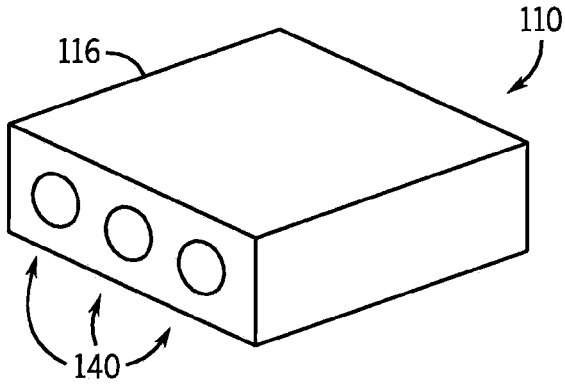

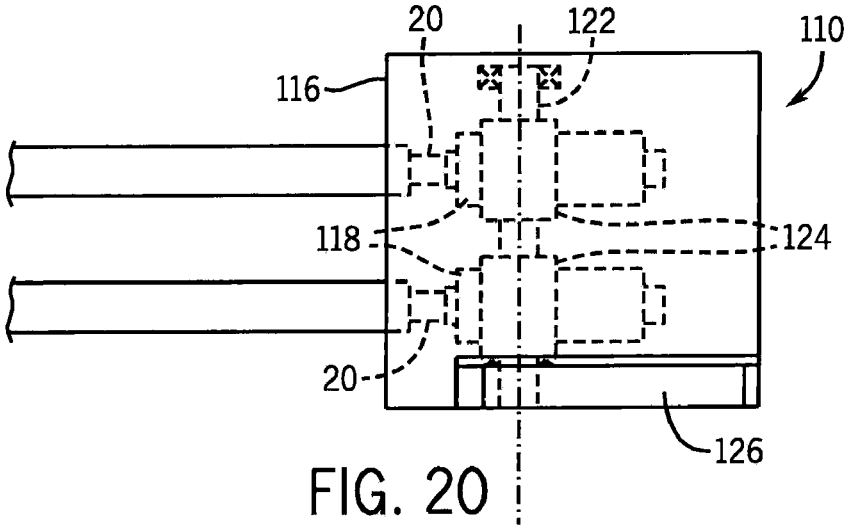
FIG. 20
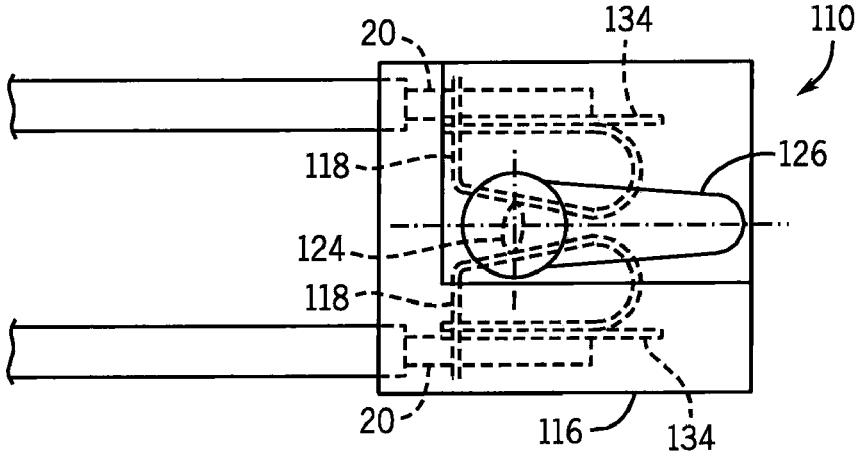
FIG. 21
FIG. 22
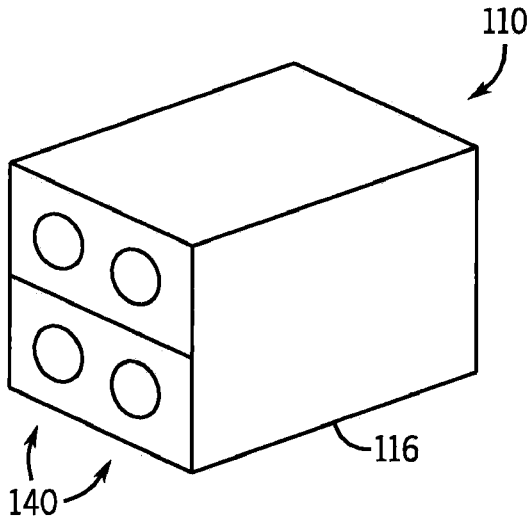

ELECTRICAL CONNECTOR FOR CONNECTION TO MULTIPLE CONDUCTORS

CROSS-REFERENCE TO RELATED APPLICATION

This application claims the benefit of U.S. Provisional Patent Application No. 61/013,912 filed Dec. 14, 2007, the disclosure of which is hereby incorporated by reference.

STATEMENT CONCERNING FEDERALLY SPONSORED RESEARCH OR DEVELOPMENT

Not applicable.

FIELD OF THE INVENTION

This invention relates to an electrical connector, specifically a low insertion force electrical connector having a lever that is actuated to install and lock conductors in the connector.

BACKGROUND OF THE INVENTION

This invention relates to electrical connectors of the type disclosed in U.S. Pat. No. 7,114,986, the disclosure of which is hereby incorporated by reference. The electrical connector disclosed includes a locking body with a plurality of cam levers. Each cam lever is independently rotatable to release and engage a conductor within the connector body. The conductors engaged within the connector body are conductors from a line side and a load side. Tools are not required to rotate the cam levers. Such an electrical connector is beneficial since the live leads are concealed within the connector if it is disconnected without turning power off in the circuit. Such an electrical connector is also beneficial since power to the light fixture may be disconnected without requiring an excessive amount of overhead effort. For certain applications, such as fluorescent light connections to the line power supply, the work can be extremely repetitive, and so it must be made as easy as possible, and may be accomplished by skilled or unskilled labor. An easy, inexpensive and fast means of making these connections is therefore needed.

SUMMARY OF THE INVENTION

The present invention provides an electrical connector for connection to multiple conductors. The connector comprises a connector housing and at least two spring clamps in the housing. Each spring clamp has an open position to permit insertion of a conductor and a closed position in which the spring clamp engages the conductor to establish an electrical connection therewith. The connector further comprises a cam shaft having at least two axially spaced cam positions thereon. One of the cam positions is aligned with each spring clamp to open the spring clamp when the cam shaft is turned to an open position and to allow the spring clamp to close when the cam shaft is turned to a closed position. The connector further comprises a lever on the cam shaft for turning the cam shaft between the open and closed positions. The connector further comprises passageways in the connector housing, one for each spring clamp, leading a conductor inserted into the passageway into the corresponding spring clamp when the spring clamp is in the open position.

In some embodiments, the electrical connector is a connector half that engages a second connector half to establish an electrical connection between conductors engaged to each electrical connector half. In some embodiments, and the spring clamps are electrically connected to each other to electrically connect the conductors to each other.

The foregoing and other objects and advantages of the invention will appear in the detailed description that follows. In the description, reference is made to the accompanying drawings that illustrate a preferred embodiment of the invention.

BRIEF DESCRIPTION OF THE DRAWINGS

FIG. 12 is a side view of a second embodiment of an electrical connector according to the present invention that includes two conductor-receiving passageways;

FIG. 13 is a top view of the electrical connector of FIG. 12;

FIG. 14 is a side view of the electrical connector of FIG. 12 with a lever, cam shaft, and bearing plate removed;

FIG. 15 is a perspective view of the electrical connector of FIG. 12 with the lever removed;

FIG. 16 is a side view of the second embodiment of an electrical connector according to the present invention that includes three conductor-receiving passageways;

FIG. 17 is a top view of the electrical connector of FIG. 16;

FIG. 18 is a side view of the electrical connector of FIG. 16 with a lever, cam shaft, and bearing plate removed;

FIG. 19 is a perspective view of the electrical connector of FIG. 16 with the lever removed;

FIG. 20 is a top view of the second embodiment of an electrical connector according to the present invention that includes four conductor-receiving passageways;

FIG. 21 is a side view of the electrical connector of FIG. 20;

FIG. 22 is a perspective view of the electrical connector of FIG. 20 with the lever removed;

DESCRIPTION OF THE INVENTION

It should be noted that the figures are schematic representations of the components of the present invention. Accordingly, several components are transparent so that other components may be seen. In addition, several components are removed from figures so that other components are not obstructed.

Figures 1, 2, 3:
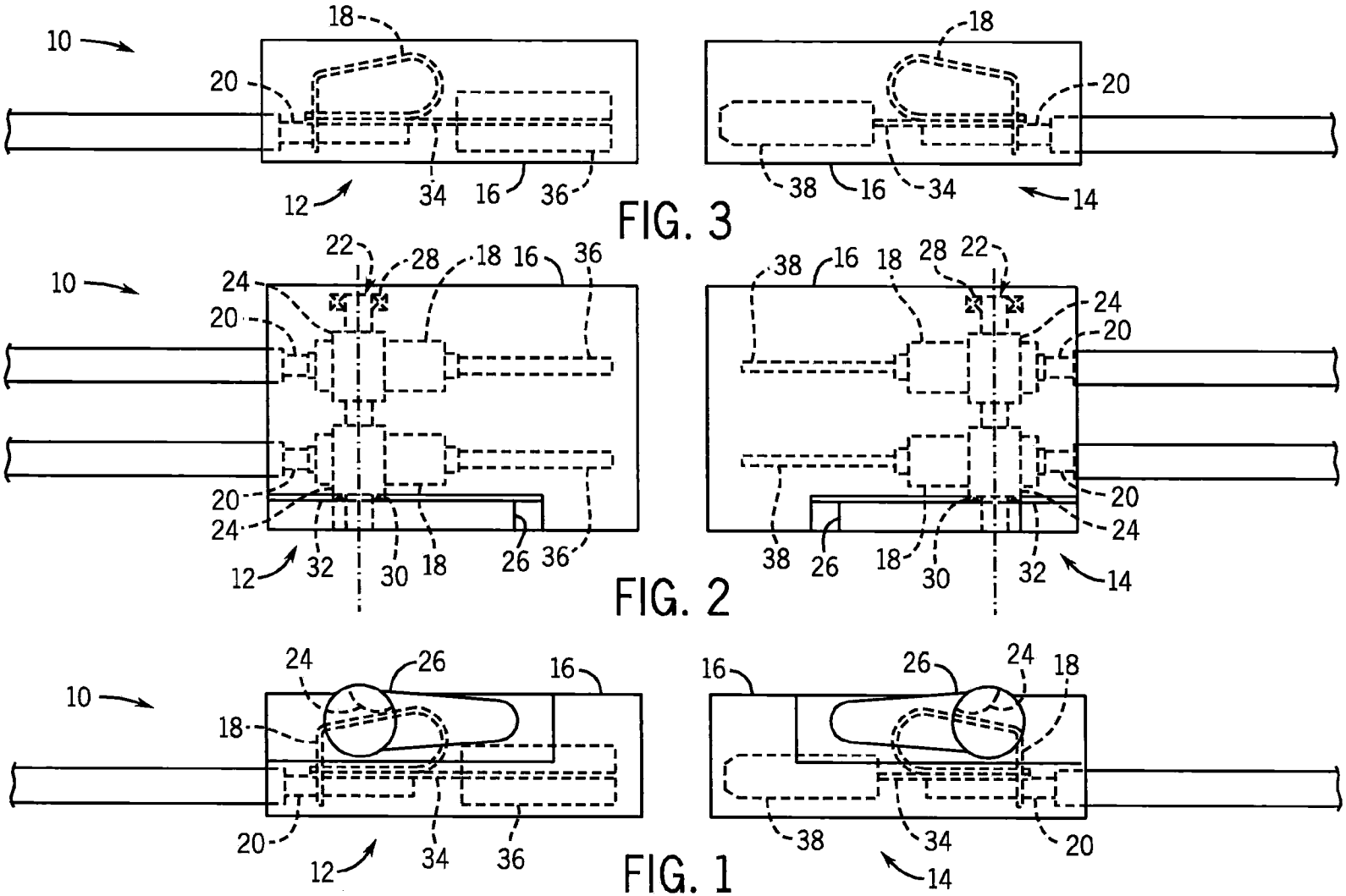
FIG. 1 is a side view of an electrical connector according to the present invention.
FIG. 2 is a top view of the electrical connector of FIG. 1.
FIG. 3 is a side view of the electrical connector of FIG. 1 with a lever, cam shaft, and bearing plate removed.

Referring to FIGS. 1, 2 and 3, in some embodiments the present invention provides an electrical connector 10 that includes two electrical connector halves 12 and 14. Each electrical connector half 12 or 14 includes a connector housing 16. The connector housing 16 houses at least two spring clamps 18. Each spring clamp 18 has an open position to permit insertion of a conductor 20 and a closed position in which the spring clamp 18 engages the conductor 20 to establish an electrical connection. The open and closed positions of the spring clamps will be discussed in further detail below. The spring clamps 18 are arranged in a side-by-side manner; that is, the spring clamps 18 are positioned in the same orientation relative to each other.

The connector housing 16 also houses a cam shaft 22. The cam shaft 22 includes at least two axially spaced cam positions 24 along the cam shaft 22 at which a spring clamp 18 can be actuated. In the embodiment illustrated in FIGS. 1-3, these are two separate cam lobes. Each single cam lobe or cam position 24 is aligned with a single spring clamp 18. Turning the cam shaft 22 to an open position causes the spring clamps 18 to move to the open position, and turning the cam shaft 22 to a closed position allows the spring clamps 18 to move to the closed position. The cross-sectional shape of the cam positions 24 may be the C-shape of FIGS. 1-7, the D-shape of FIGS. 8-11, or any shape, as described in further detail below, that in the closed position of the lever 26 permits the spring to clamp the conductor 20 and in the open position of the lever 26 bears against the spring to permit insertion or retraction of the conductor 20. The cam shaft 22 further includes a lever 26 for turning the cam shaft 22 between the open and closed positions.

The cam shaft 22 is supported by a first bearing 28 that is fixed to the connector housing 16. The cam shaft 22 is also supported by a second bearing 30 that is fixed to a bearing plate 32. The bearing plate 32 covers a hole (not shown) that is used to insert the cam shaft 22 into the connector housing 16 during assembly. As an alternative, the bearings 28 and 30 may simply be holes in the respective housing 16 and plate 32 in which the shaft 22 is journalled.

The connector housing 16 includes passageways (not shown), one for each clamp, that lead the conductor 20 into engagement with the corresponding spring clamp 18. Each spring clamp 18 is connected to a post 34 that connects to a contact within the connector housing 16. The contacts in the connector half 12 are female contacts 36. The contacts in the connector half 14 are male contacts 38. In addition, the connector halves 12 and 14 are designed such that they connect and create an electrical connection between the contacts 36 and 38, as shown in FIG. 7.

Figure 4:
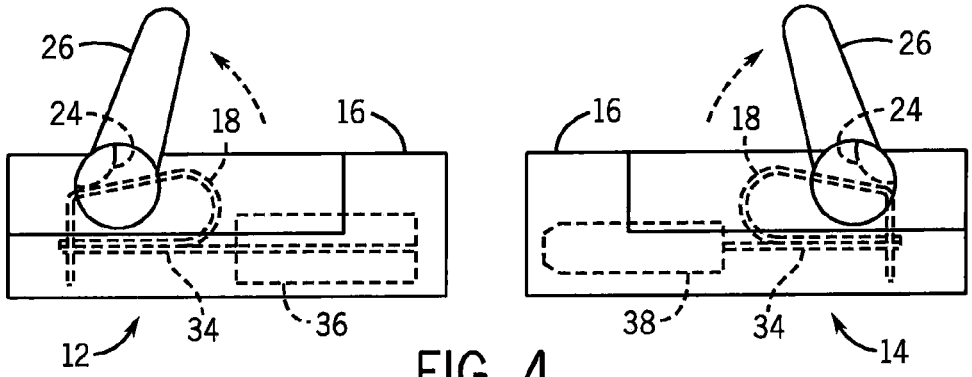
FIG. 4 is a side view of the electrical connector of FIG. 1 with levers in an open position.
Figure 5:
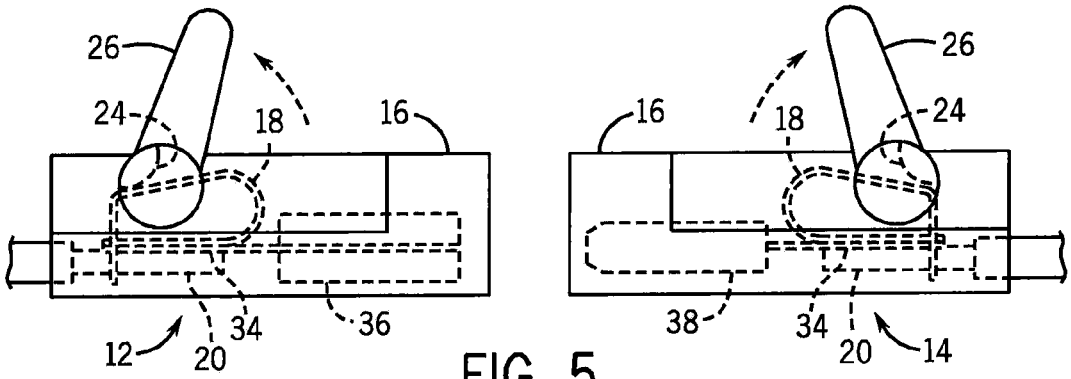
FIG. 5 is a side view of the electrical connector of FIG. 1 with levers in the open position and conductors inserted into the connector.
Figure 6:
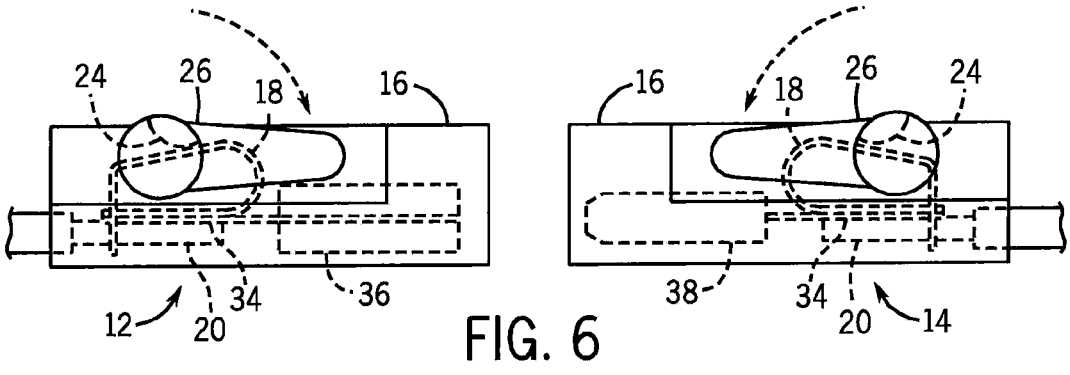
FIG. 6 is a side view of the electrical connector of FIG. 1 with levers in a closed position and the conductors forming electrical connections with contacts.
Figure 7:
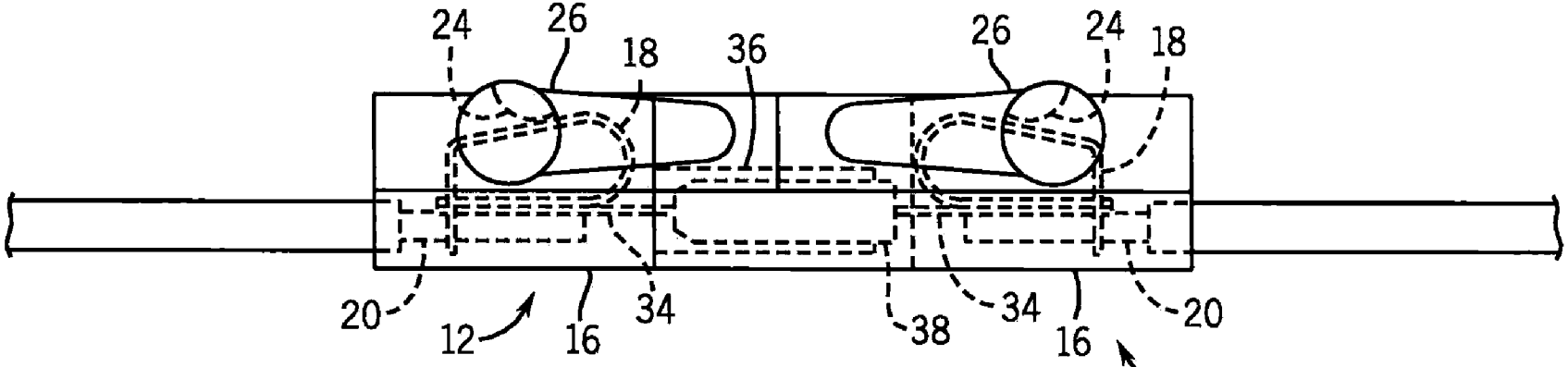
FIG. 7 is a side view of the electrical connector of FIG. 1 with two connector halves connected to form an electrical connection between the conductors.
Figure 8:
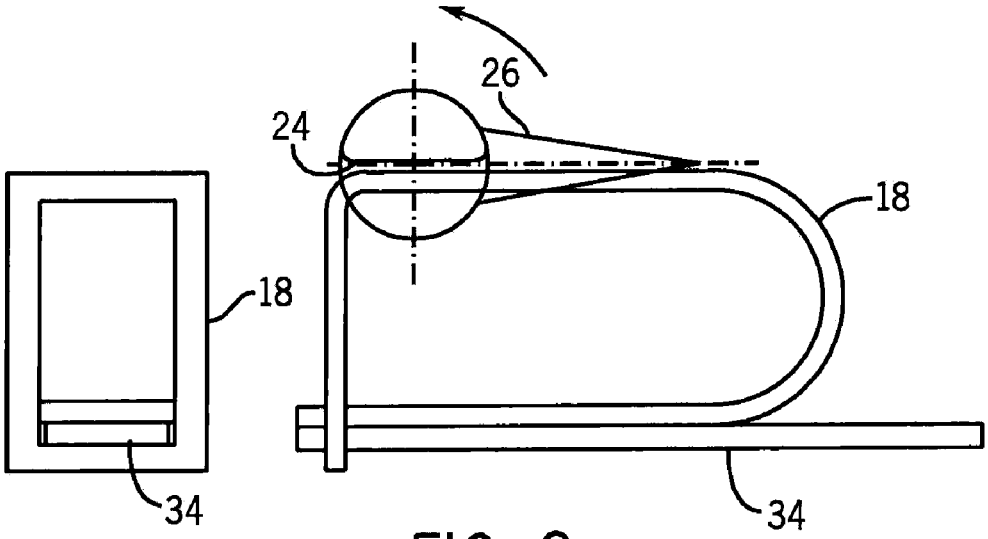
FIG. 8 is a side view of a spring clamp and the lever in the closed position without an inserted conductor.
Figure 9:
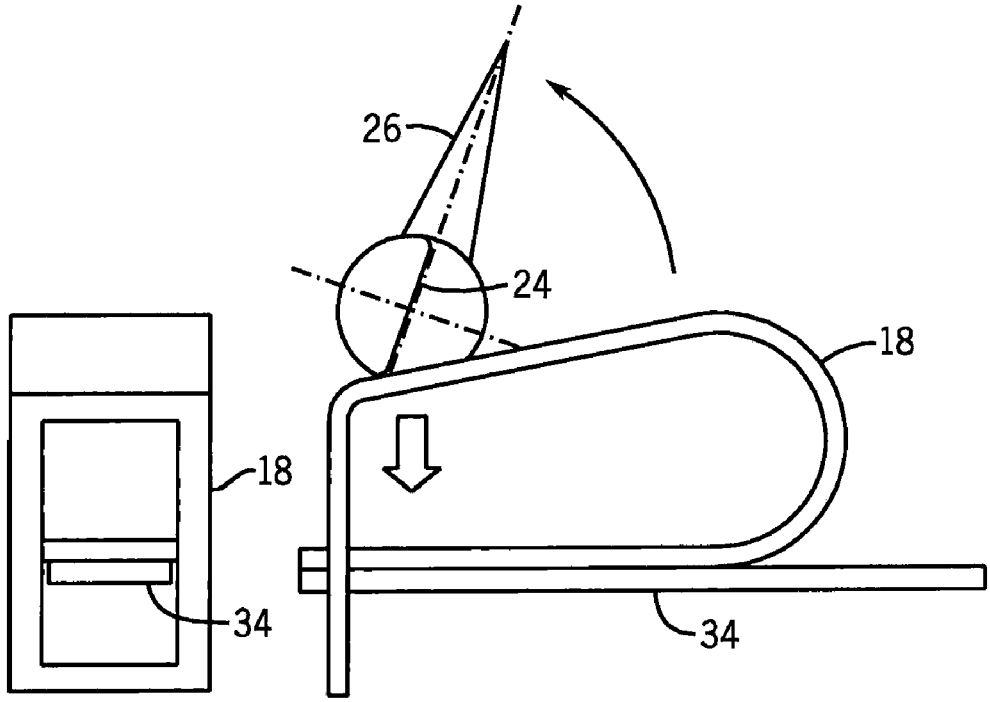
FIG. 9 is a side view of the spring clamp and the lever of FIG. 8 in the open position without an inserted conductor.
Figure 10:
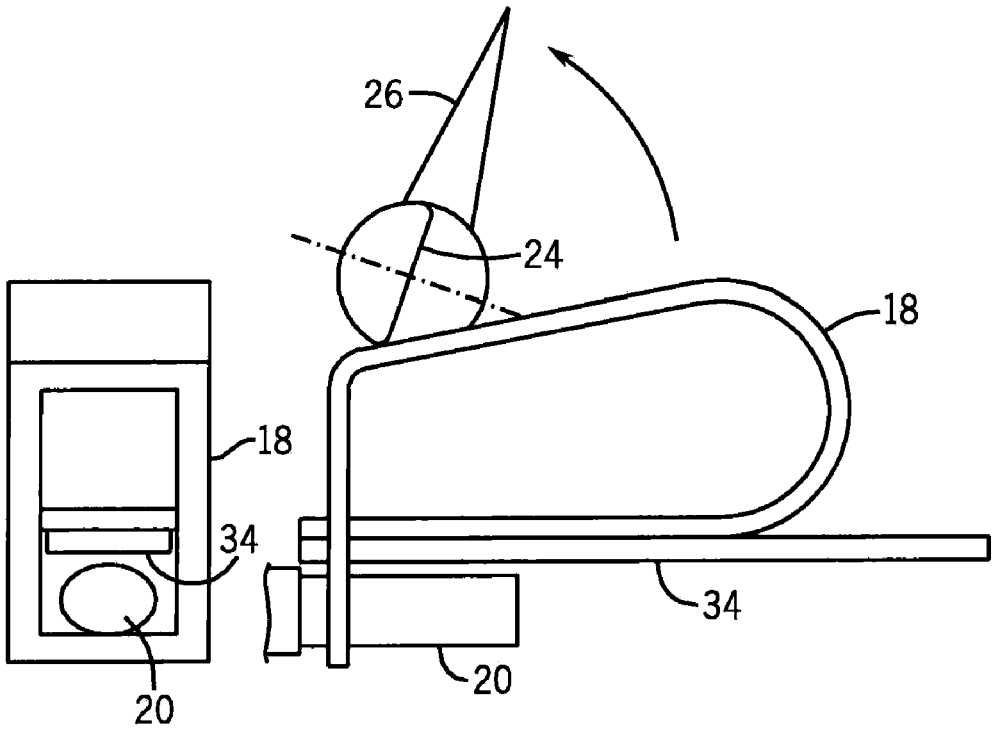
FIG. 10 is a side view of the spring clamp and the lever of FIG. 8 in the open position with an inserted conductor.
Figure 11:
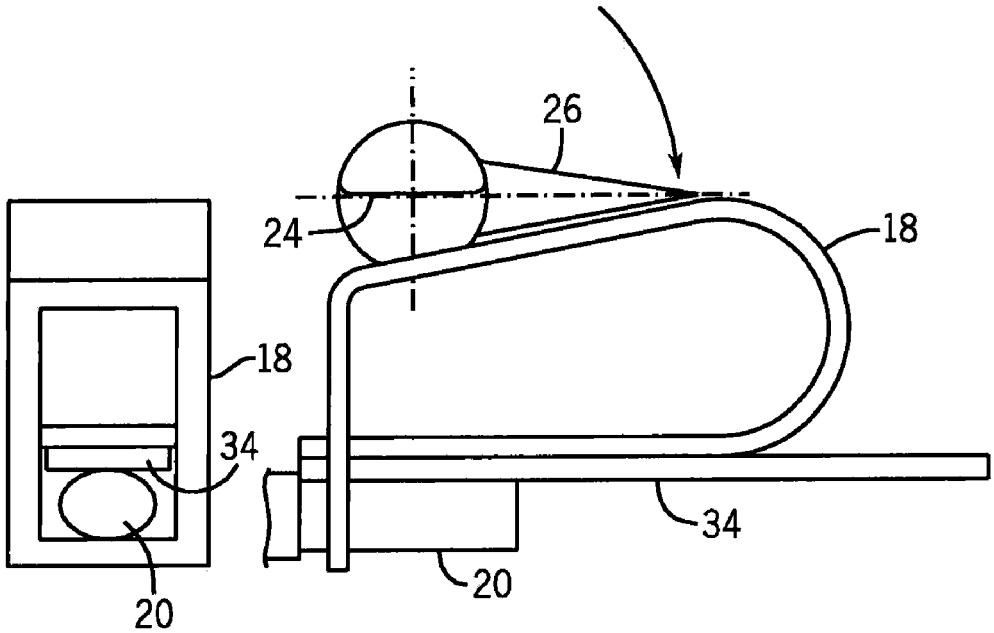
FIG. 11 is a side view of the spring clamp and the lever of FIG. 8 in the closed position with an inserted conductor.
Figure 23:
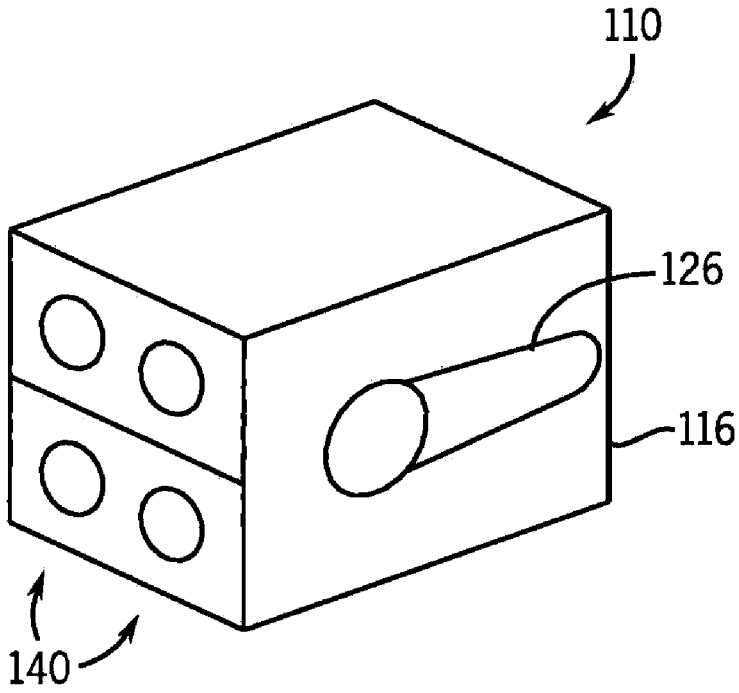
FIG. 23 is a perspective view of the electrical connector of FIG. 20.
Figure 24:
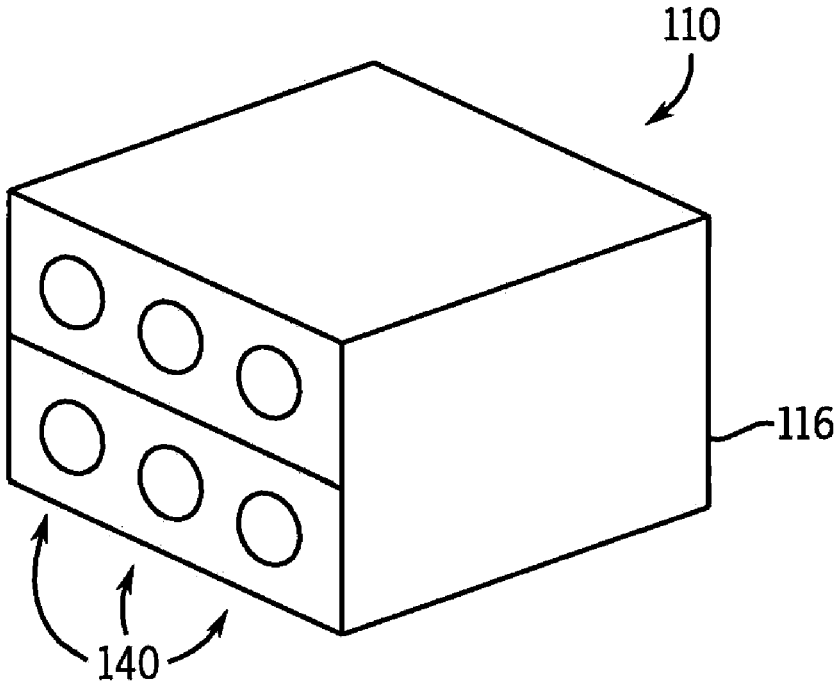
FIG. 24 is a perspective view of the second embodiment of an electrical connector according to the present invention that includes six conductor-receiving passageways.
Figure 25:
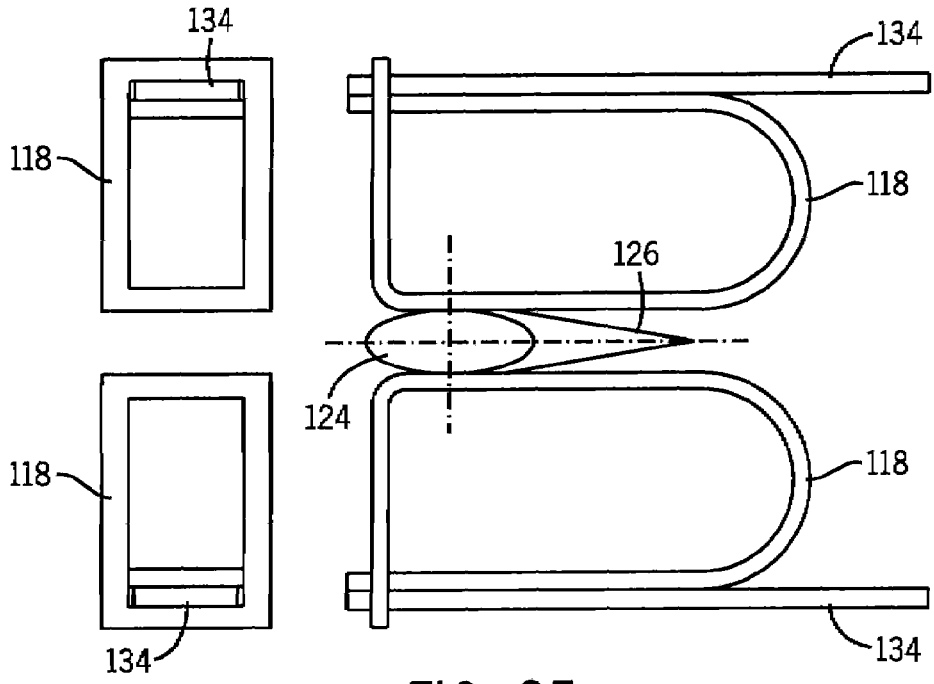
FIG. 25 is a side view of a spring clamp and the lever in the closed position without an inserted conductor.
Figure 26:
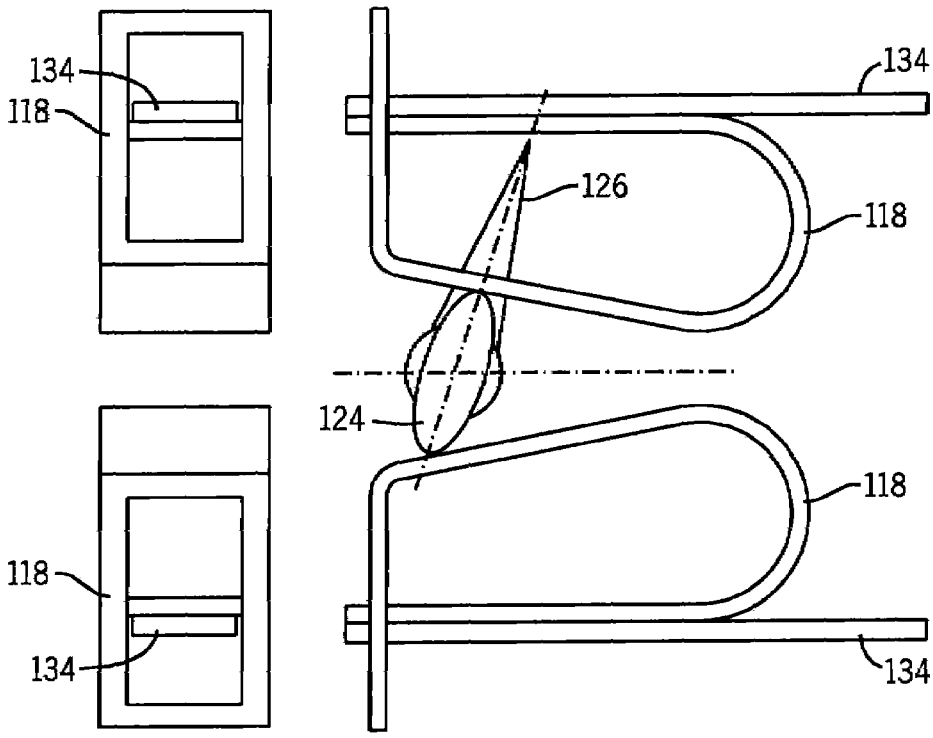
FIG. 26 is a side view of the spring clamp and the lever of FIG. 25 in the open position without an inserted conductor.

A conductor 20 is inserted into an electrical conductor half 12 or 14 using the steps shown in FIGS. 4-11. As shown in FIGS. 4, 8, and 9, the lever 26 is rotated away from the connection housing 16 (or opened). This causes the cam lobes 24 to contact the spring clamps 18 and create an opening between the spring clamp 18 and the bottom of the post 34, as shown in FIGS. 8 and 9. The lever 26 preferably remains in this open position without being held. As shown in FIGS. 5 and 10, the conductor 20 is next inserted into the opening between the spring clamp 18 and the bottom of the post 34. As shown in FIGS. 6 and 11, the lever is rotated towards the connection housing 16 (or closed). This clamps the conductor 20 between the spring clamp 18 and the post 34, forming an electrical connection. As shown in FIG. 7, the electrical conductor halves 12 and 14 are connected to form an electrical connection between the ballast/load side and the line side.

The electrical connector 10 is not limited to two sets of spring clamps 18, cam positions 24, and contacts as shown in the figures. Any number of additional sets of these components may be added to the electrical connector 10. Insertion and clamping of a conductor into each passageway is controlled by the single lever 26 for quick installation and removal of the conductors. In addition, the cam positions 24 could be defined by separate cam lobes, as illustrated, or could be spaced along a single, longer cam lobe.

Referring now to FIGS. 12-26 in some embodiments the present invention provides a general-purpose electrical connector 110 that includes a connector housing 116. The connector housing 116 houses at least two spring clamps 118 that contact posts 134. However, the posts 134 do not connect to male or female contacts as described above. Instead, the spring clamps 118 electrically connect to each other through a separate conductor (not shown) positioned within the housing 116 or the posts 134 themselves may be electrically conductive and span the spring clamps 118 so as to connect the spring claims 118. As a result, the electrical connector 110 provides an electrical connection between two or more conductors 20.

Other components of the electrical connector 110 and insertion of the conductors 20 into the connector 110 are generally as described above. For example, a single lever 126 and cam shaft 122 having multiple cam positions 124 controls opening and closing of all the spring clamps 118. In addition, the electrical connector 110 may include conductor-receiving passageways 140 arranged in a side-by-side configuration (FIGS. 12-19), a stacked configuration (FIGS. 25-26), or both (FIGS. 20-24). In configurations in which passageways 140 are stacked, such as FIG. 25, the cam shaft 122 is positioned between pairs of stacked spring clamps 118 and the cam positions 124 may have an elliptical shape.

Preferred embodiments of the invention have been described in considerable detail. Modifications and variations of these embodiments will be apparent to those skilled in the art so the invention should not be limited to the embodiments described, but should be defined by the claims which follow.

The invention claimed is:

1. An electrical connector, comprising:

a connector housing;

at least two spring clamps in the housing, each spring clamp having an open position to permit insertion of a conductor and a closed position in which the spring clamp engages the conductor to establish an electrical connection therewith;

a cam shaft having at least two axially spaced cam positions thereon, one said cam position aligned with each said spring clamp to open the spring clamps when the cam shaft is turned to an open position and to allow the spring clamps to close when the cam shaft is turned to a closed position;

a lever on the cam shaft for turning the cam shaft between the open and closed positions; and passageways in the connector housing, one for each spring clamp, leading a conductor inserted into the passageway into the corresponding spring clamp when the spring clamp is in the open position.

2. The electrical connector of claim 1, wherein the cam shaft has two axially spaced cam lobes thereon.

3. The electrical connector of claim 1, wherein the cam shaft has more than two axially spaced cam lobes thereon.

4. The electrical connector of claim 1, wherein the connector housing includes a bearing to support the cam shaft.

5. The electrical connector of claim 1, further including a plate that helps journal the cam shaft.

6. The electrical connector of claim 5, wherein the plate includes a bearing to journal the cam shaft.

7. The electrical connector of claim 1, wherein the cam shaft is located inside the connector housing.

8. The electrical connector of claim 1, wherein the lever remains in an open position until a user moves the lever to a closed position.

9. An electrical connector half, comprising:

a connector housing;

at least two spring clamps in the housing, each spring clamp having an open position to permit insertion of a conductor and a closed position in which the spring clamp engages the conductor to establish an electrical connection therewith;

a cam shaft having at least two axially spaced cam positions thereon, one said cam position aligned with each said spring clamp to open the spring clamps when the cam shaft is turned to an open position and to allow the spring clamps to close when the cam shaft is turned to a closed position;

a lever on the cam shaft for turning the cam shaft between the open and closed positions;

passageways in the connector housing, one for each spring clamp, leading a conductor inserted into the passageway into the corresponding spring clamp when the spring clamp is in the open position; and contacts within the connector housing, each contact being electrically connected to a corresponding spring clamp.

10. The electrical connector half of claim 9, wherein the contacts are flat style contacts.

11. The electrical connector half of claim 9, wherein the electrical connector half engages a second electrical connector half to establish an electrical connection between conductors engaged to each electrical connector half.

12. The electrical connector half of claim 9, wherein the cam shaft has two axially spaced cam lobes thereon.

13. The electrical connector half of claim 9, wherein the cam shaft is located inside the connector housing.

14. An electrical connector, comprising:

a connector housing;

at least two spring clamps in the housing, each spring clamp having an open position to permit insertion of a conductor and a closed position in which the spring clamp engages the conductor to establish an electrical connection therewith, the spring clamps being electrically connected to each other;

a cam shaft having at least two axially spaced cam positions thereon, one said cam position aligned with each said spring clamp to open the spring clamps when the cam shaft is turned to an open position and to allow the spring clamps to close when the cam shaft is turned to a closed position;

a lever on the cam shaft for turning the cam shaft between the open and closed positions; and passageways in the connector housing, one for each spring clamp, leading a conductor inserted into the passageway into the corresponding spring clamp when the spring clamp is in the open position.

15. The electrical connector of claim 14, wherein the connector housing includes a bearing to support the cam shaft.

16. The electrical connector of claim 14, wherein the cam shaft has two axially spaced cam lobes thereon.

17. The electrical connector of claim 14, wherein at least some of the passageways are arranged in a side-by-side configuration.

18. The electrical connector of claim 14, wherein at least some of the passageways are arranged in a stacked configuration.

19. The electrical connector of claim 18, wherein the cam shaft is positioned between at least some of the spring clamps.

20. The electrical connector of claim 14, wherein at least some of the cam positions have an elliptical shape.

* * * * *